United States Patent [19]

Kern et al.

[11] Patent Number: 4,623,788

[45] Date of Patent: Nov. 18, 1986

[54] FIBER OPTIC SYSTEM WITH SELF TEST USED IN FIRE DETECTION

[75] Inventors: Mark T. Kern, Goleta; Steven E. Hodges, Santa Barbara, both of Calif.

[73] Assignee: Santa Barbara Research Center, Goleta, Calif.

[21] Appl. No.: 557,684

[22] Filed: Dec. 2, 1983

[51] Int. Cl.[4] ..... H01J 5/16

[52] U.S. Cl. ..... 250/227; 250/554

[58] Field of Search ..... 340/506, 512, 514, 577, 340/578, 600; 250/227, 231 R, 554; 356/73.1

[56] References Cited

U.S. PATENT DOCUMENTS

| | | | |
|---|---|---|---|
| 4,119,949 | 10/1978 | Lindgren | 340/600 |
| 4,207,561 | 6/1980 | Steensma | 340/600 |
| 4,242,669 | 12/1980 | Crick | 340/512 |
| 4,294,263 | 10/1981 | Hochman | 340/600 |
| 4,385,832 | 5/1983 | Doi et al. | 356/73.1 |
| 4,403,143 | 9/1983 | Walker et al. | 250/227 |
| 4,449,043 | 5/1984 | Husbands | 250/227 |
| 4,523,092 | 6/1985 | Nelson | 250/227 |
| 4,533,829 | 8/1985 | Miceli et al. | 250/227 |

*Primary Examiner*—David C. Nelms
*Assistant Examiner*—L. W. Madoo
*Attorney, Agent, or Firm*—Ronald L. Taylor; A. W. Karambelas

[57] ABSTRACT

A fire detection system incorporating fiber optics and having a selectively energizable light source for applying light pulses to a fiber optics path and a one way light transmitting element, such as a dichroic mirror, at the remote end of the fiber optics path for reflecting the pulses back to the detection portion of the system, thus providing a Built In Test Equipment (BITE) test capability in the system. Instead of a dichroic mirror, a bandpass filter may be used as the light transmitting member. The bandpass filter is selected to transmit light with wavelengths in the range from about 1.3 to 1.5 microns, in which case the light source is a light emitting diode (LED) emitting light at a wavelength of approximately 0.9 microns. The fiber optics path includes a branch which is coupled to the light source. This branch may comprise one fiber of a multi-fiber bundle or it may be an auxiliary fiber of a commercially available fiber optics combiner.

An overall system incorporates a plurality of these individual fire detection arrangements in conjunction with a BITE control stage and associated fire alarm. Any detected fire activates the fire alarm. However, the same fire detection signal, when the system is operated in the BITE test mode, is used by the BITE apparatus to detect failures in the system and identify the portion of the system experiencing the failure.

32 Claims, 5 Drawing Figures

Fig. 1.
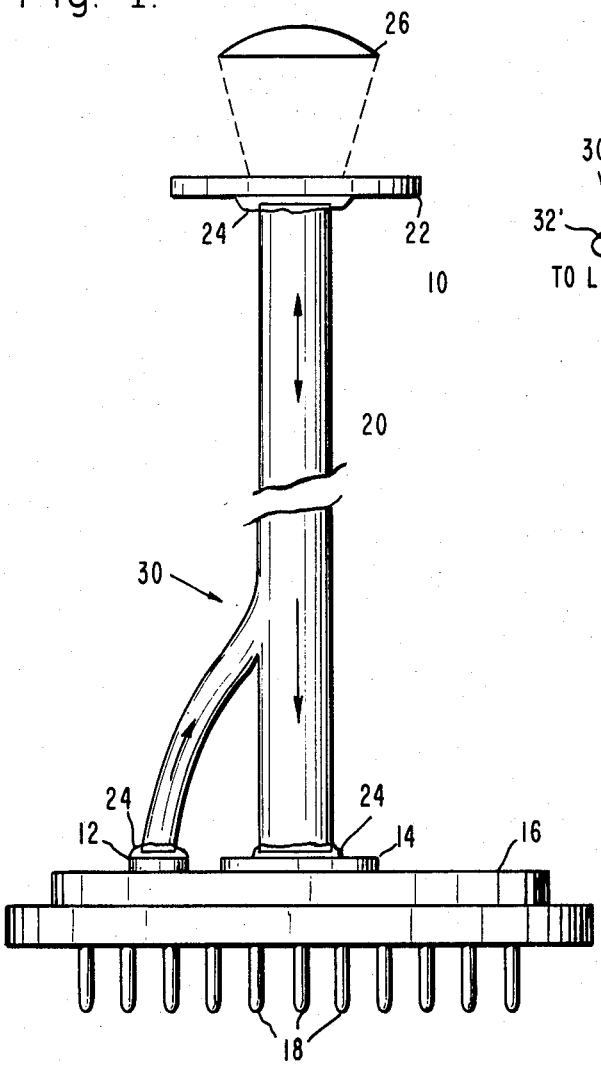
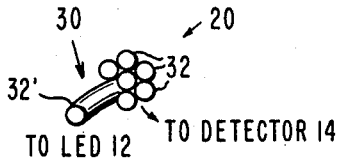
Fig. 2.
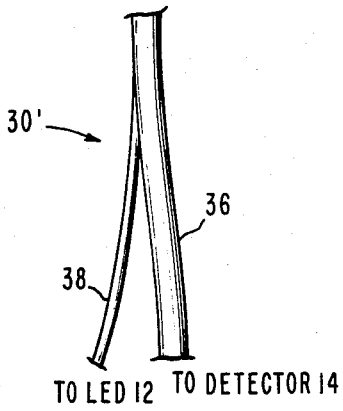
Fig. 3.

FIBER OPTIC SYSTEM WITH SELF TEST USED IN FIRE DETECTION

BACKGROUND OF THE INVENTION

1. Field of the Invention

This invention relates to the field of fiber optics and, more particularly, to the use of fiber optics in a fire sensing system.

2. Description of the Prior Art

The technology of fiber optics finds application in a great many fields. Since 1970, when researchers at Corning Glass Works announced the first low loss optical fiber (less than 20 dB/km) in long lengths (hundreds of meters), the fiber optics industry has been experiencing an explosive growth. Communications applications have been dominant and are therefore primarily responsible for sparking the technological development.

The principle upon which fiber optics depend for their effectiveness is that of total internal reflection. An optical fiber consists of a cylindrical core of material (usually glass or plastic) clad with a material (either glass or plastic) of lower refractive index, thus preventing light loss through the exterior surface for incident light within the fiber acceptance cone.

A second principal feature of optical fibers contributing to their broad application in various fields of use is the extreme thinness of the fiber which enables it to be very flexible. Optical fibers typically are fabricated to diameters as small as 5 microns and ranging upward to 500 microns or more. These fibers are then typically assembled in bundles or cables, sometimes referred to as "light guides", which still exhibit substantial flexibility and can be used for various purposes.

Many technical applications of fiber optics use either "incoherent" or "coherent" bundles of fibers. In an incoherent light guide, there is no relationship between the arrangement of the individual fibers at the opposite ends of the bundle. Such a light guide can be made extremely flexible and provides a source of illumination to inaccessible places. When the fibers in a bundle are arranged so that they have the same relative position at each end of the bundle, the light guide is known as coherent. In this case, optical images can be transferred from one end to the other.

Thus, optical fiber transmission systems find a wide variety of uses such as, for example, in the interconnection of telephones, computers and various other data transmission systems (communications); in the fields of instrumentation, telemetry and detection systems; and in the medical field (bronchoscopes, endoscopes, etc.), to name but a few. For example, in the field of medical instrumentation, an incoherent light guide offers the best means of safely illuminating a point inside the body, since it provides light without heat. A coherent light guide can be used in conjunction therewith for observation or photography.

SUMMARY OF THE INVENTION

In brief, arrangements in accordance with the present invention provide a self-test capability for a fiber optic system. As mentioned hereinabove, a fiber optic bundle, or cable, may be used to probe inaccessible or remote areas. In such instances, it is often important or even essential to be assured that the fiber optic cable is intact and has not suffered a break or rupture which would interfere with the effectiveness of optical transmission of the cable.

One particular arrangement in accordance with the present invention is utilized in a fiber optic system designed for fire detection and/or suppression. In such a system, it is important to provide a Built In Test Equipment (BITE) feature and it is not acceptable to depend upon the placement of any electronic devices at a remote end of the optical fiber cable for such a purpose. In accordance with the invention, a partially reflective element is mounted at the remote end of the fiber in a manner which interferes minimally with illumination from a fire reaching the end of the fiber. The proximal end of the fiber is coupled to a detector for responding to light transmitted through the fiber. A light source, preferably positioned adjacent the detector, is coupled to transmit light into the fiber. In operation, a pulse of light from the light source travels the length of the fiber, is reflected at the remote end, and returns to illuminate the detector, thus providing an appropriate indication of the integrity of the optical fiber transmission path. If there is a break in the fiber there may be some slight reflection from the break, but the reflection from the remote end is absent and the difference in level of reflected light is readily distinguishable.

In the preferred embodiment of the invention, the partially reflective element at the remote end of the fiber (which may be referred to as a "reflective/transmissive member") comprises a dichroic mirror and the light source comprises a light emitting diode (LED). The LED may be optically coupled to one fiber of a multiple fiber bundle with the remaining fibers being coupled to the detector. A pulse of light emitted by the LED travels the length of the fiber, is reflected by the dichroic mirror, and returns to illuminate both the LED and the detector. No effect results from the LED illuminating itself. However, the detector responds to the reflected light of the LED and, through appropriate signal processing, generates a PASS signal for the BITE mode which originated the LED light pulse. In normal operation, the dichroic mirror does not affect the operation of the fiber optic system as a fire detector. Light in the vicinity of the remote end of the optical fiber is transmitted into the fiber via the dichroic mirror.

In one configuration of a fiber optic bundle suitable for use in such systems, seven 200-micron diameter fibers can be arranged within a diameter of 600 microns. One of these fibers is connected to the LED; the other six fibers are maintained in the cable coupled to the detector.

Another particular arrangement in accordance with the present invention incorporates a bandpass filter in place of the dichroic mirror. Such filters are known in the art and may be selectively configured to transmit light having a wavelength between 1.3 and 1.55 microns and to reflect light at other wavelengths. In this arrangement, an LED selected to generate light at a wavelength of 0.9 microns will produce the same effect as in the arrangement using the dichroic mirror.

In still another arrangement in accordance with the invention, as for example where a single optical fiber instead of a fiber optics bundle is utilized, light from the LED may be coupled into the fiber by means of an optical fiber combiner or a fiber connector. Such a device couples light into an optical fiber very effectively but substantially maintains the light travelling in the opposite direction within the fiber. Thus, a light pulse from the LED enters the optical fiber and travels to the remote end where it is reflected and returned to the detector. Light from a fire or any other source at the remote end will be transmitted directly to the detector over the optical fiber.

BRIEF DESCRIPTION OF THE DRAWING

A better understanding of the present invention may be had from a consideration of the following detailed description, taken in conjunction with the accompanying drawing in which:

FIG. 1 is a schematic diagram representing one particular arrangement in accordance with the present invention;

FIG. 2 is a diagram showing details of a particular portion of the arrangement of FIG. 1;

FIG. 3 is a diagram representing an alternative arrangement for the portion illustrated in FIG. 2;

DESCRIPTION OF THE PREFERRED EMBODIMENTS

Figure 5:
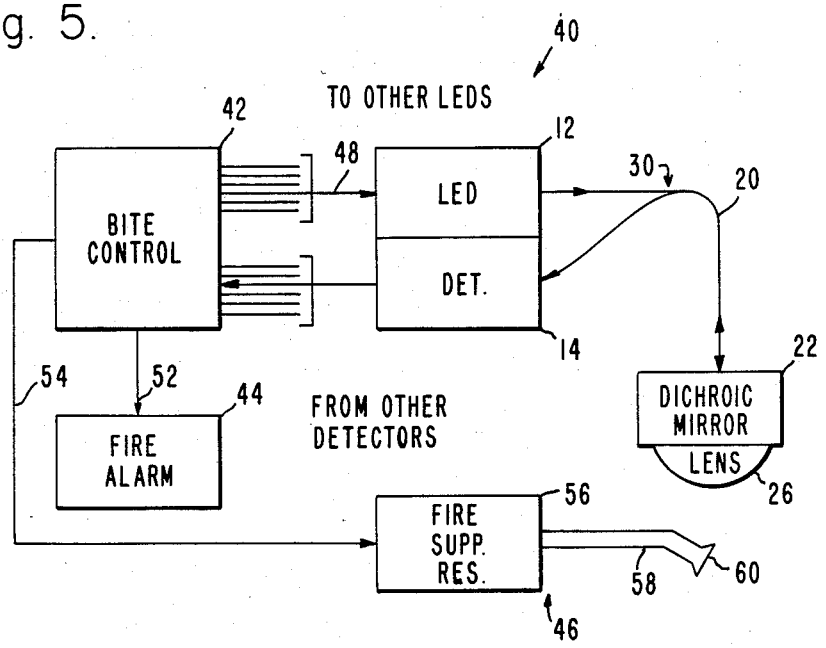
FIG. 5 is a schematic block diagram illustrating a fire detection system incorporating the arrangement of FIG. 1.

The fire detection test system 10 of FIG. 1 is shown comprising a light emitting diode (LED) 12 and a detector 14 installed on a header 16 having a plurality of terminal pins 18 for insertion in a circuit board socket or the like. A split fiber optical element 20, which may be a single optical fiber element or a bundle of fibers arranged in a cable, extends between the LED 12 and detector 14 at one end and a member 22 at the other end. The respective ends of the element 20 are mounted to the LED 12, the detector 14 and the member 22 by suitable epoxy or similar transparent adhesive 24. The element 20 includes a junction 30 for coupling light thereto from the LED 12.

The member 22 is adapted to be reflective on the surface adjacent the element 20. That is, it reflects back into the element 20 light which reaches the member 22 from the optical fiber element 20 but transmits light through the member 22 which is incident on the other side, as from the lens 26 positioned adjacent thereto. Member 22 may be a dichroic mirror or it may comprise a bandpass filter selectively configured to transmit light having a wavelength between 1.3 and 1.55 microns and to reflect light at other wavelengths. In the latter case, the LED 12 would be selected to generate light at a wavelength of 0.9 microns, thus developing the same effect for the bandpass filter of member 22 as when a dichroic mirror is employed.

In operation of the detection test system 10 of FIG. 1 the lens 26 and the member 22 coupled to the remote end of the fiber element 20 can be placed in a generally inaccessible area, due to the extremely small size of the elements and the flexibility of the fiber optical element 20. Illumination from a fire adjacent the location of the member 22 and lens 26 will be passed to the fiber 20 which in turn directs it to the detector 14 so that a fire alarm may be sounded and/or automatic discharge of fire suppressant initiated. In order to test the integrity of the system, particularly the fiber optic element 20, the LED 12 may be energized. Light from the LED 12 passes into the main body of the fiber optics element 20 toward the member 22. There it is reflected backward into the fiber optics element 20 and transmitted to the detector 14 to provide an indication that the system is in proper operating condition.

FIG. 2 illustrates one particular arrangement of the junction 30 for directing light from the LED 12 to the member 22 and then back to the detector 14. In the arrangement of FIG. 2, the fiber optics element 20 is a bundle of seven individual fibers 32 arranged in a cable. Six of the fibers 32 are coupled to the detector 14; the remaining fiber, designated 32', is coupled to the LED 12. The space between the end of the bundle 20 and the reflective surface of member 22 is configured so that light from the fiber 32' is coupled back into the fibers 32. Thus, light from the LED 12 passes along the fiber 32' to the member 22 where it is reflected back into all of the fibers 32 making up the cable element 20. Light reflected back along the six fibers 32 is directed to the detector 14 where the appropriate test response is developed. Light reflected back along the fiber 32' and directed to the LED 12 produces no response at the LED 12.

FIG. 3 illustrates schematically an alternative arrangement to the fiber optic junction 30 of FIG. 2. FIG. 3 illustrates a combiner 30' comprising a principal fiber 36 to which an auxiliary fiber 38 is joined at its termination. Such combiners are commercially available and operate in a way whereby light entering the junction from the auxiliary fiber 38 passes into the principal fiber 36 with very little loss or reflection while the light lost from the principal fiber 36 into the auxiliary fiber 38 is minimized. The result in using the combiner 30' of FIG. 3 is equivalent to that described with respect to the junction 30 of FIG. 2. If desired, an optical fiber connector may be used in place of the combiner 30' for inter-coupling the respective fibers as indicated.

Figure 4:
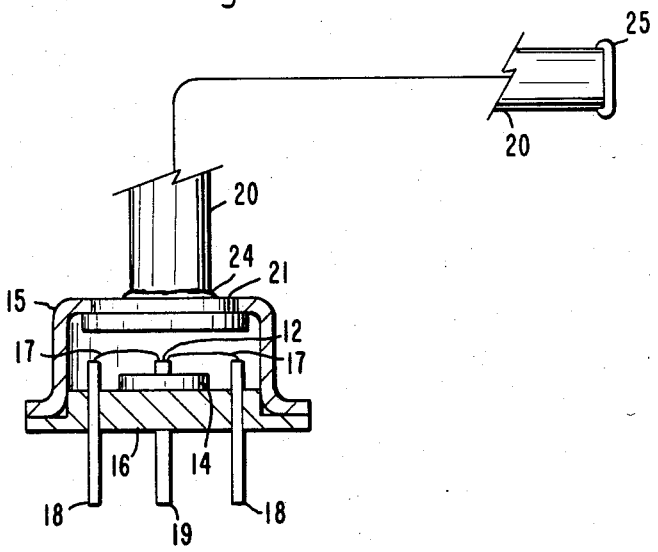
FIG. 4 is a diagram representing an alternative arrangement to the detector block included in FIG. 1.

FIG. 4 illustrates an alternative arrangement for mounting the LED 12 and the detector 14 in juxtaposition with the optical fiber element 20. The detector 14 is shown mounted on the base 16 enclosed within a header can 15. A transparent window 21 is mounted in an opening at the top of the header can 15, and the fiber element 20 is affixed to the upper surface of the window 21 by means of epoxy 24. The LED 12 is mounted directly on top of the detector 14, coaxially therewith, and connected to terminals 18 via wires 17. Terminal 19 is one of the terminals provided for making electrical connections to the detector 14. As with the operation of the LED/detector configuration of FIG. 1, the LED 12 in FIG. 4 may be pulsed to generate light which passes upward through the optical fiber element 20 for reflection and re-direction back down the fiber element 20 to impinge on the detector 14 where the appropriate output signal is generated.

At the distal end of the fiber optic element 20 there is shown a terminating member 25 which is provided to serve the function of the lens 26 and dichroic mirror 22 of FIG. 1. This terminating member 25 may, under certain conditions, comprise the lapped and polished end of the optical fiber element 20, or it may comprise a drop of epoxy, also suitably lapped and polished, mounted on the end of the fiber element 20. As thus formed, the terminating member 25 presents a polished surface which both transmits light from the ambient surroundings into the fiber element 20 and at least partially reflects light directed outward along the element 20 back into the fiber optic element. The terminating member 25 provides a degree of reflectivity which is detectably greater than the reflectivity of a break in the fiber, which in most cases presents a jagged or rough surface that is guide low in reflectivity. Such a broken end of an optical fiber is approximately 2 to 3% reflective. The polished end of the fiber element 20 is approximately 4 to 5% reflective, essentially twice as reflective as a broken end of the fiber. A suitably prepared coating of epoxy or the like on the end of the fiber element 20 may provide approximately 10% reflectivity while at the same time serving effectively to transmit the illumination from a flame in the vicinity of the distal end of the fiber into the fiber element 20. Alternatively the terminating member 25 may comprise a neutral density coating on the end of the optical fiber element 20, which coating is approximately 50% reflective and 50% transmissive. As a further alternative, the terminating member 25 may comprise a plano-convex lens, like the lens 26 shown in the arrangement of FIG. 1 but without the dichroic mirror interposed. The planar face of a plano-convex lens is both reflective and transmissive, and can therefore serve the described function of the terminating member 25 when coupled to the distal end of the fiber element 20. Another possibility is to use a miniature self-focusing lens, known in the art as a Selfoc lens.

FIG. 5 illustrates in block diagram form a fire detection system 40 incorporating the test feature of the present invention. In FIG. 5, the arrangement of FIG. 1, generally comprising the LED 12, the detector 14, the fiber optics element 20 with junction 30, and the reflective/transmissive member 22 and lens 26, is shown coupled to a BITE control stage 42 associated with a fire alarm 44 and fire suppressant system 46. In normal operation of the fire detection system 40 of FIG. 5, the BITE control stage 42 is set to pass any signals from the detector 14, received via the path 50, to the fire alarm 44 via path 52, thereby enabling the fire alarm 44 to sound a warning or otherwise indicate the detection of a fire in the vicinity of the lens 26. Signals may also be directed via path 54 to the suppressant system 46 to activate the system so that suppressant from the reservoir 56 is directed toward the detected fire through plumbing 58 and nozzle 60. However, in the BITE test mode, the stage 42 will be set to interrupt the connection between paths 50 and 52, while at the same time it energizes the LED 12 via path 48 to generate a light pulse directed into the fiber optics element 20 for reflection back to the detector 14 in the manner described in conjunction with FIG. 1. The resulting signal in the path 50 from the detector 14 is utilized within the BITE control stage 42 to generate a PASS signal for the BITE test mode, thus indicating the integrity of that particular branch of the fire detection system. As illustrated in FIG. 5, a multiplicity of branches may be coupled to the single BITE control stage 42 and fire alarm 44, thus making up a complete fire detection system. The plurality of branches may be tested selectively by the BITE control stage 42 and any failure in an individual branch may be readily detected and the branch identified.

Arrangements in accordance with the present invention as disclosed hereinabove provide an effective means of testing a fire detection system which is normally dormant and not activated but must be continuously effective and ready to respond to the presence of a fire. The present invention enables the system to be tested on a regular basis to assure that the system is operative and to enable the prompt detection of any malfunction so that the system can be restored to proper operating condition. Arrangements in accordance with the present invention obviate the need for the installation by any light generating elements at the remote terminations of the fire detection sensors, thus eliminating the need for any special electronics or electrical connections to such remote locations. Instead, arrangements in accordance with the present invention utilize the fiber optics of the fire detection system itself to achieve the BITE feature.

Although there have been described above specific arrangements of a fiber optics system with self test capability in accordance with the invention for the purpose of illustrating the manner in which the invention may be used to advantage, it will be appreciated that the invention is not limited thereto. For example, although the disclosed systems are shown with one LED for each detector, it will be apparent that a single LED could be used with a plurality of detectors through the use of suitable coupling arrangements. Conversely a plurality of LEDs could be used with a single detector, if desired. A two-color system could also be employed, if desired, to enhance the discrimination and detection capability of the system. Accordingly, any and all modifications, variations or equivalent arrangements which may occur to those skilled in the art should be considered to be within the scope of the invention as defined in the annexed claims.

What is claimed is:

1. A test apparatus for testing a fire detection system incorporating fiber optics between a detector coupled to a proximal end of a fiber optics element and a light pickup coupled to the distal end of said element, the test apparatus comprising:

a reflective/transmissive member mounted at the distal end of the fiber optics element for reflecting light reaching the member from the fiber optics element while passing light directed in the opposite direction into the fiber optics element;

a light source mounted adjacent to the detector for emitting a light pulse to be injected into the fiber optics element in the direction of the reflective/transmissive member;

means for coupling light pulses from the light source into the fiber optics element adjacent the proximal end and directing them toward said member while passing light in an opposite direction along the fiber optics element from said member toward the detector; and means for selectively controlling the light source to emit light pulses in order to test the integrity of the fire detection system whereby light from the source is reflected by said member back to the detector through the fiber optics element during the test.

2. The apparatus of claim 1 further including means for responding to signals from the detector corresponding to said light pulses to provide a signal indicating the condition of the fire detection system.

3. The apparatus of claim 1 wherein the reflective/transmissive member comprises a dichroic mirror having its reflective surface directed toward the fiber optics element.

4. The apparatus of claim 1 wherein the light pickup comprises a lens mounted to focus light on the distal end of the fiber optics element.

5. The apparatus of claim 4 wherein the reflective/transmissive member is mounted between the lens and the distal end of the fiber optics element.

6. The apparatus of claim 1 wherein the reflective/transmissive member comprises a bandpass filter configured to transmit light having wavelengths within a predetermined range and to reflect light at other wavelengths.

7. The apparatus of claim 6 wherein the bandpass filter is configured to transmit light having a wavelength between 1.3 and 1.55 microns.

8. The apparatus of claim 7 wherein the light source comprises a light emitting diode emitting light, when energized, at a wavelength of approximately 0.9 microns.

9. The apparatus of claim 1 wherein the fiber optics element comprises a bundle of individual optical fibers arranged in a flexible cable, at least one of said fibers being coupled between the light source and the reflective/transmissive member, and wherein the remainder of said fibers are coupled between said member and the detector.

10. The apparatus of claim 1 wherein the fiber optics element includes a combiner having a branch coupled to the light source.

11. The apparatus of claim 10 wherein the combiner comprises a principal fiber for transmitting light in both directions and an auxiliary fiber affixed to the principal fiber for coupling light from the light source into the principal fiber.

12. A fire detection system comprising:

a detector coupled to fire responsive means for generating a signal to energize said means in response to light received from a fire;

a fiber optics element coupled to the detector and adapted to extend into a remote location where fire is to be detected for transmitting light to the detector from the vicinity of a fire;

a reflective/transmissive member mounted at a distal end of the fiber optics element for reflecting light reaching the member from the fiber optics element while passing light directed in the opposite direction into the fiber optics element;

a light source mounted adjacent the detector for emitting a light pulse to be injected into the fiber optics element in the direction of the reflective/transmissive member;

means for coupling light pulses from the light source into the fiber optics element adjacent the proximal end and directing them toward said member while passing light along the fiber optics element from said member toward the detector; and means for selectively controlling the light source to emit light pulses in order to test the integrity of the fire detection system whereby light from the source is reflected by said member back to the detector through the fiber optics element during the test, and fire responsive means coupled to the detector for responding to the detection of light directed into the fiber optics element through the reflective/transmissive member.

13. The system of claim 12 further including means for responding to signals from the detector corresponding to said light pulses to provide a signal indicating the condition of the fire detection system.

14. The system of claim 12 wherein the reflective/transmissive member comprises a dichroic mirror having its reflective surface directed toward the fiber optics element.

15. The system of claim 12 further including a lens mounted to focus light on the distal end of the fiber optics element.

16. The system of claim 15 wherein the reflective/transmissive member is mounted between the lens and the distal end of the fiber optics element.

17. The system of claim 12 further including built-in test equipment control apparatus for selectively energizing the light source and for diverting the light detection signal from the detector away from the fire responsive means and applying said signal to provide an indication of operability for the system under test.

18. The apparatus of claim 17 comprising a plurality of fire detection branches, each including a detector, a fiber optics element, a reflective transmissive member, a light source, and said light coupling means, the built-in test equipment control means being coupled to said branches to selectively test the integrity of each branch when operating in the built-in test equipment mode.

19. The system of claim 18 wherein each reflective/transmissive member comprises a bandpass filter configured to transmit light having a wavelength between approximately 1.3 and 1.5 microns.

20. The system of claim 19 wherein each light source comprises a light emitting diode emitting light, when energized, at a wavelength of approximately 0.9 microns.

21. The system of claim 18 wherein each reflective/transmissive member comprises a dichroic mirror.

22. The system of claim 15 wherein the lens is a miniature self-focusing lens.

23. The system of claim 12 wherein the reflective/transmissive member comprises a shaped terminating element at the distal end of the fiber optics element.

24. The system of claim 23 wherein the terminating element comprises the end of the fiber optics element lapped and polished to develop an internal reflective surface which is detectably more reflective than the end of a broken optical fiber.

25. Test apparatus for testing a fire detection system incorporating fiber optics comprising:

at least one fiber optics element having a pair of opposite ends, the distal end of the element being adapted to pick up light from a fire;

a detector coupled to the proximal end of the fiber optics element for generating an output signal in response to light received over the fiber optics element;

partially reflective means at the distal end of the fiber optics element for reflecting at least a portion of light reaching said means from the fiber optics element while passing light directed in the opposite direction into the fiber optics element, said means providing a level of reflectivity for light received along the fiber optics element which is detectably higher than the level of reflectivity normally presented by a broken fiber end;

a light source coupled to the fiber optics element adjacent the proximal end thereof for emitting a light pulse into the fiber optics element in the direction of said means; and control circuitry for selectivity controlling the light source to emit light pulses and coupled to receive output signals from the detector corresponding to the reflection of said light pulses by said means in order to test the integrity of the fire detection system.

26. The apparatus of claim 25 wherein said control circuitry includes means for distinguishing between output signals from the detector corresponding to reflected light from the light source and light from a fire picked up by the distal end of the fiber optics element.

27. The apparatus of claim 25 wherein the partially reflective means comprise a dichroic mirror.

28. The apparatus of claim 27 further including a lens for focusing light from a fire through the dichroic mirror and into the fiber optics element.

29. The apparatus of claim 25 wherein said means comprise a plano-convex lens having a partially reflective surface facing the distal end of the fiber optics element.

30. The apparatus of claim 25 wherein said means comprise the distal end of the fiber optics element lapped and polished to develop an increased level of reflectively relative to the reflectivity of a broken end of a fiber.

31. The apparatus of claim 25 wherein said means comprise a bead of epoxy affixed to said distal end and lapped and polished to develop an increased level of reflectivity relative to the reflectivity of a broken end of a fiber.

32. The apparatus of claim 25 further including fire suppressant means for extinguishing a fire detected by said detector, said fire suppressant means being coupled to said control circuitry and responsive to a fire detection signal therefrom.

* * * * *